US005609053A

United States Patent [19]

Ferreira et al.

[11] Patent Number: 5,609,053

[45] Date of Patent: Mar. 11, 1997

[54] CONSTANT REDUCTION MULTI-STAND HOT ROLLING MILL SET-UP METHOD

[75] Inventors: Adriano M. P. Ferreira, Bridgeport, W. Va.; Terry L. Horton, Martville, N.Y.

[73] Assignee: Alcan Aluminum Corporation, Cleveland, Ohio

[21] Appl. No.: 293,834

[22] Filed: Aug. 22, 1994

[51] Int. Cl.[6] ..... B21B 37/02

[52] U.S. Cl. ..... 72/9.2; 72/11.8; 72/234; 72/365.2

[58] Field of Search ..... 72/8–13, 234, 72/235, 365.2, 366.2

[56] References Cited

U.S. PATENT DOCUMENTS

| | | | |
|---|---|---|---|
| 3,820,366 | 6/1974 | Smith, Jr. | 72/13 |
| 5,054,302 | 10/1991 | Yamashita et al. | 72/16 |

FOREIGN PATENT DOCUMENTS

| | | | |
|---|---|---|---|
| 1156329 | 11/1993 | Canada | 72/365.2 |
| 0391658 | 10/1990 | European Pat. Off. | 72/365.2 |
| 4213381 | 7/1967 | Japan . | |
| 0084215 | 6/1980 | Japan | 72/13 |
| 0139420 | 8/1982 | Japan | 72/12 |
| 0023509 | 2/1983 | Japan | 72/13 |
| 0045884 | 9/1988 | Japan | 72/365.2 |
| 0233004 | 9/1989 | Japan | 72/13 |
| 0498046 | 1/1976 | U.S.S.R. | 72/366.2 |
| 0662179 | 4/1979 | U.S.S.R. | 72/13 |
| 0995945 | 2/1983 | U.S.S.R. | 72/13 |

*Primary Examiner*—W. Donald Bray
*Assistant Examiner*—Thomas C. Schoeffler
*Attorney, Agent, or Firm*—Cooper & Dunham LLP

[57] ABSTRACT

This invention relates to a method and apparatus for improving rolling mill efficiency by providing modified fixed setup parameters according to the class of the material being rolled through the following steps: (1) divide the products produced by the rolling mill into hardness/rollability classes; (2) empirically establish a set of fixed interstand thicknesses for each class which produce desired operational characteristics, such as constant thermal operation; and (3) vary the entry thickness for a particular product in accordance with the set of fixed interstand thicknesses for its class proportionally based on the desired exit thickness.

10 Claims, 2 Drawing Sheets

$$X := \begin{bmatrix} 500 & 430 & 250 & 130 \\ 550 & 400 & 200 & 100 \\ 410 & 420 & 180 & 80 \\ 0 & 0 & 0 & 0 \\ 430 & 330 & 160 & 75 \\ 490 & 310 & 150 & 60 \\ 210 & 180 & 110 & 70 \\ 200 & 160 & 70 & 50 \\ 0 & 0 & 0 & 0 \\ 0 & 0 & 0 & 0 \\ 0 & 0 & 0 & 0 \end{bmatrix}$$

$$Y := \begin{bmatrix} 1500 \\ 950 \\ 550 \\ 350 \\ 250 \end{bmatrix} \qquad r := \begin{bmatrix} 37 \\ 42 \\ 36 \\ 29 \end{bmatrix}$$

FIG. 2

CONSTANT REDUCTION MULTI-STAND HOT ROLLING MILL SET-UP METHOD

FIELD OF THE INVENTION

This invention relates to a method for improving rolling mill efficiency by providing fixed setup parameters according to the class of the material being rolled, and more particularly, to a method for selecting setup parameters in a rolling mill according to classes of material which are based upon the hardness and rollability of the material in order to control rolling stand temperatures in the rolling mill.

BACKGROUND OF THE INVENTION

A rolling mill typically includes a series of rolling stands which reduce the thickness of a web or strip of material, such as aluminum or steel, in intermediate stages during which the web of material is compressed between rollers of the successive stands. Although the process may be adapted to obtain different products, the rolling process is essentially a deforming process.

The three variables having the largest effect on the resulting product appear to be: (1) the compressive force used to spread, shape or separate the web material; (2) the drive torque which propels the strip through the mill; and (3) the excess heat generated from the mechanical work performed by the rolling operation.

Variables, also referred to as parameters, include both directly controlled variables, such as stand screwdown, and indirectly controlled variables such as compressive force. The directly controlled variables can affect one or more indirectly controlled variables. For example, the greater the amount of screwdown, the closer together are the rolls of the stand, and the greater the compressive force and heat on both the stand and the strip.

While the compressive force is employed to cause the desired deformation, the drive torque and the excess heat affect the deforming process in complex ways. For example, a large amount of drive torque is generated by motors of one stand to drive or thread the strip at a desired speed through the roll bite (entry point) of a subsequent stand. This drive torque deforms the web material which affects the profile and flatness (shape) of the rolled product. Also, the excess heat affects the web material in other ways which can affect the quality of the product.

Additionally, the effects of the drive torque and the excess heat on the strip may interfere with the operation of the rolling mill by causing roll bite threading problems, such as bite refusals, and by causing deterioration of the shape of the threading portion of the strip. These problems result in production delays, lower production rates and poorer quality product. For example, delays can cause the thermal crown to decay both on the work (contact) rolls and also on the backup (support) rolls.

Accurate tandem mill setup procedures are of major importance in avoiding threading problems and in maintaining a high production rate. The primary requirement for controlling the stands during threading is to allow the strip to thread with acceptable tension transients and shape. Strip shape is of overriding importance in threading the first 10 feet of the strip since, unlike the running conditions, there is no tension in the gap between stands. This lack of tension increases the likelihood of buckling with consequent difficulties in feeding the leading edge into the next stand gap.

Solutions to threading problems are made more complex with the requirement for 'schedule free' rolling. Schedule free rolling allows any of the possible products produced by the rolling mill to be made one after another without major adjustments to the mill for the transition. For example, in a traditional rolling mill, if the production of one product generates a large amount of excess heat, one would have to delay the production of a second product to allow the heat to dissipate. In one typical instance, this delay could amount to approximately 30 minutes in lost production time.

A mill which avoids excess heat buildup could reduce such delays. Attempts to accomplish schedule free rolling have focused on optimization of three traditional rolling mill quality measures: (1) the number of cobbles (splices in the strip); (2) the coil head gauge (thickness of the strip at the end of the rolling mill where the product is wound into a coil); and (3) the coil head temperature (temperature of the strip at the end of the rolling mill where the product is wound into a coil). Ideally, when a strip reaches the coil head, the strip has no cobbles, but has the desired thickness and the desired temperature. Accomplishment of these ideal measures yields a correct and optimal power balance at the coil head, is more robust in dealing with the presence of transients in strip tension and strip shape as the product is rolled and allows for schedule free rolling.

U.S. Pat. No. 3,820,366 (Smith, Jr.) discusses previous attempts to achieve these ideal measures. Smith counsels the adjustment of the rolling mill variables, such as the amount of stand screwdown, based on the difference in the temperature of a strip being rolled and the average temperature for earlier productions of the particular product.

Another approach, Canadian Pat. No. 1,156,329 (Dekker et al.), selects the rolling mill setup parameters, such as the amount of thickness reduction for each stand, the tension on the strip between stands, and the like, by classifying the web material into one of several standard thickness groups. According to Dekker, each thickness group is defined by entry thickness, exit thickness and exit surface roughness. Once a product is classified, standard setup parameters for that particular thickness group are retrieved and modified according to the difference between the standard thickness group and the particular requirements of the strip to be processed.

As explained by Dekker, the method modifies or adjusts interstand thickness and interstand tension, among other setup parameters, to approach these ideal measures and maintain optimum threadability of the strip. In practice, however, little benefit appears to result from modifying interstand tensions. Accordingly, compensation is achieved traditionally by adjusting the web material thickness after each stand, that is, by adjusting each stand's thickness reduction. However, adapting the standard values of the setup parameters used for the running condition to obtain values for the threading condition cannot adequately address the initial threading conditions unless a set of additional complex calculations specifically designed for the initial threading conditions is used.

A further mill setup procedure used to achieve ideal measures employs horsepower-hour/ton versus thickness reduction curves. However, these curves tend to yield varying thickness reductions, particularly on the first stand which promotes transients, instability and unpredictable threading shape. This type of compensation method is fairly complex to implement, and difficult to understand. It also appears unable to achieve ideal measures.

SUMMARY OF THE INVENTION

The subject invention provides a method for determining setup parameters for classes of material based upon the hardness and rollability characteristics of the material. For each class of material setup parameters are selected such that the temperature of the stands in the rolling mill will remain substantially constant while the web of material is threaded and rolled. Since the temperature of the stands and the web material are substantially constant, different products can be rolled one after the other without delay and without affecting product quality while stands cool down or heat up.

The subject invention also provides a method for selecting the entry thickness of a web of material which will permit the temperature of the stands in the mill to remain substantially constant. Specifically, an embodiment of the subject invention solves the above problems by: (1) dividing the products into hardness classes; (2) establishing a set of fixed interstand thicknesses for each class based on a specific exit coil thickness; and (3) varying the entry thickness proportionally for different desired coil thicknesses.

More specifically, the subject invention provides a method for selecting setup parameters for rolling stands in a rolling mill which reduces the thickness of web materials by: (1) determining several web material classes according to similar hardness and rollability characteristics; (2) determining the thicknesses for web material of each class to have between rolling stands such that temperatures remain substantially constant; (3) selecting a product to produce from a particular web material; (4) determining which class includes the web material of the product; (5) determining the exit thickness of the product; and (6) calculating the thicknesses including the entry thickness for the web material according to the class of the web material.

The subject invention further provides a rolling mill for processing web material, the rolling mill having several rolling stands for successively reducing the thickness of the web material, each rolling stand having a detector which measures the thickness of the web material at the output of the rolling stand and generates a signal indicating the web material thickness and a controller which generates command signals for the rolling stands according to the measured web material thickness and a predetermined thickness setpoint. The predetermined thickness setpoint is chosen to maintain substantially constant temperatures based on hardness and rollability characteristics of the web material.

BRIEF DESCRIPTION OF THE FIGURES

FIG. 2 illustrates a class versus stand matrix in accordance with an embodiment of the subject invention.

DETAILED DESCRIPTION OF THE PREFERRED EMBODIMENTS

The subject invention operates by fixing the amount of thickness reduction for each individual stand for a specific product range or class. Since the amount of thickness reduction affects such indirect variables as average bite temperature and amount of strain hardening of the strip, the average bite temperature and the amount of strain hardening are controlled without directly manipulating these setup parameters. Also, since other indirect variables, such as average flow stress, specific force, specific torque and strip exit temperature, are affected by the average bite temperature and the amount of strain hardening, these indirect variables are controlled by the amount thickness reduction as well. Additionally, the bite length, which is determined by the specific force and specific torque, increases with increasing thickness reduction. Thickness reduction also affects the coefficient of friction within the roll bite by changing both the differential speed between roll and strip surfaces and the temperature and pressure effect on the viscosity of the lubricant film. Thus, controlling only the thickness reduction effectively controls the other setup parameters to produce a simple and robust rolling mill operation which minimizes the effect of transients on the steady state of a rolling mill.

Additionally, the subject invention provides for more productive 'schedule-free' rolling mill operation by maintaining a substantially constant temperature at each rolling stand, by controlling the amount of thickness reduction and by varying the entry thickness of the strip. The thickness reductions are selected from a predetermined set of thickness reductions which have been empirically determined to maintain the temperature.

Figure 1:
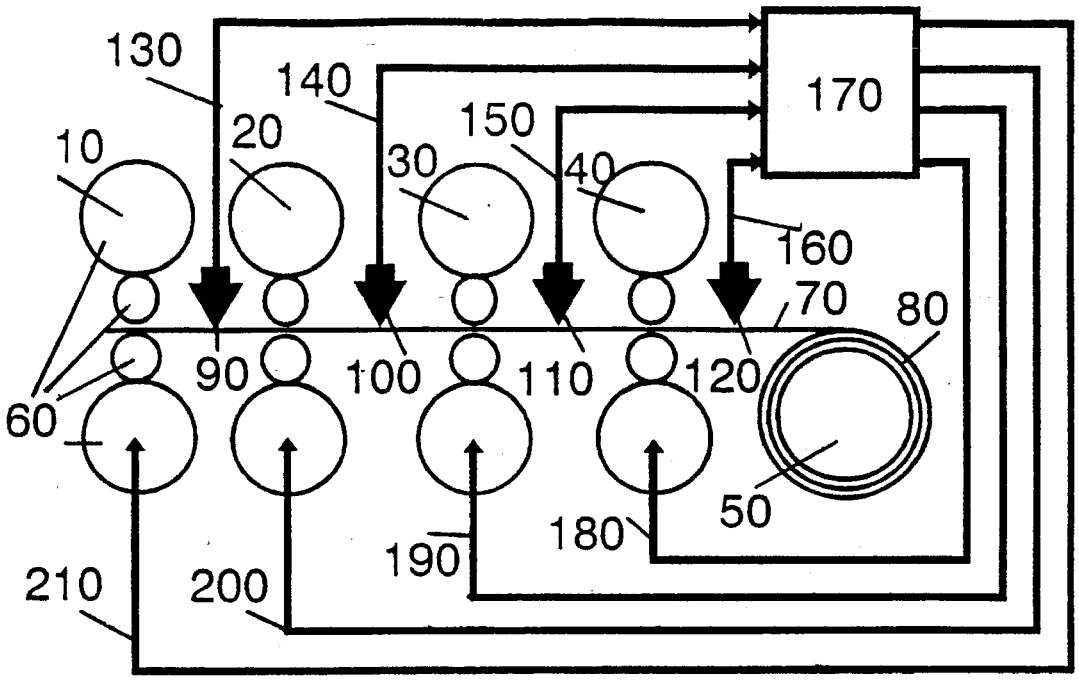
FIG. 1 illustrates a rolling mill operating in accordance with an embodiment the subject invention.

FIG. 1 is an illustration of one embodiment of the subject invention. In this embodiment, a rolling mill has four successive rolling stands 10, 20, 30, 40 and a coiling device 50. A strip of a web material 70 such as aluminum or steel is fed through rollers 60 of the stands to compress or reduce the thickness of the strip in successive stages to produce a desired product which is wound into a coil 80. Thickness detectors 90, 100, 110 and 120 are positioned at the output of each rolling stand 10, 20, 30, 40, respectively, to measure the thickness of the strip as the strip emerges from the respective rolling stand. The thickness detectors produce respective thickness measurement signals 130, 140, 150, 160 which are output to a controller 170. The controller 170 calculates what changes need to be made to directly controlled parameters for each stand, such as the roller speed or screwdown, to maintain a setpoint thickness at the output of the rolling stand.

The setpoint thicknesses are fixed values which are based on the hardness and rollability characteristics of the web material strip 70 being rolled. In one embodiment, a classification system is used to determine the setpoint thicknesses for the web material strip. In this classification system, the web materials used in a particular rolling mill are categorized into a few classes, typically four to ten classes, based on similar hardness and rollability characteristics. The optimal setpoint thickness for the output of each stand for each class is empirically determined for the specific rolling mill according to well-known principles, such as from prior operator experience and/or from specific tests.

For schedule free rolling, the setpoint thicknesses should be selected to maintain particular temperatures at each stand in the rolling mill; however, other factors or combinations of factors can be used to determine the optimum setpoints. For example, another factor of importance in a given mill could be minimizing the number of screwdown changes. These setpoint thicknesses are then used to derive a relationship between the classes and fixed thicknesses for the particular rolling mill. In FIG. 2, a particular example of the relationship between classes and fixed thicknesses is represented in the form of a matrix. In this matrix, each column corresponds to one stand and each row corresponds to one class. The elements of the matrix are the empirically derived draft, that is, load settings for each stand. However, in other embodiments the elements of the matrix can be thickness reduction percentages or other measures that represent the amount of thickness reduction for a particular stand.

Also, in FIG. 2, the rows of matrix X containing only zeros are used to allow for the addition of new classes and/or for representing to the controller 170 that no setup drafts have been determined for the selected class. Thus, when no setup drafts have been determined for the selected class, the controller 170 can implement an alternative setup strategy and control method which does not depend on the matrix X.

In operation, before a product is to be rolled, the operator inputs into the controller 170, or another computer for calculation and subsequent download to the controller 170, the class of the web material to be reduced and the desired exit thickness. Since the class corresponds to a row in the matrix, the controller 170 can calculate the setpoint thickness for the output of each stand, the thickness reduction percentage for each stand and the entry thickness required to maintain temperatures in the rolling mill.

Mathematically, if 'n' is the number of stands, '$Y_n$' is the desired exit thickness and each element of matrix '$X_{(c,i)}$' is the draft for a corresponding stand for a class 'c' of web material, and if the class 'c' is known, the setpoint thickness '$Y_i$' for each stand and the entry thickness '$Y_0$' can be calculated according to the following iterative equation:

$$\text{for } i=n \text{ to } 1,\ Y_{i-1}=Y_i+X_{(c,i)}.$$

From the setpoint thicknesses '$Y_i$', the thickness reduction '$r_i$' percentage can be calculated according to the following iterative equation:

$$\text{for } i=0 \text{ to } n-1,\ r_{i+1}=100\times(Y_{i+1}-Y_i)/Y_i.$$

Figure 3:
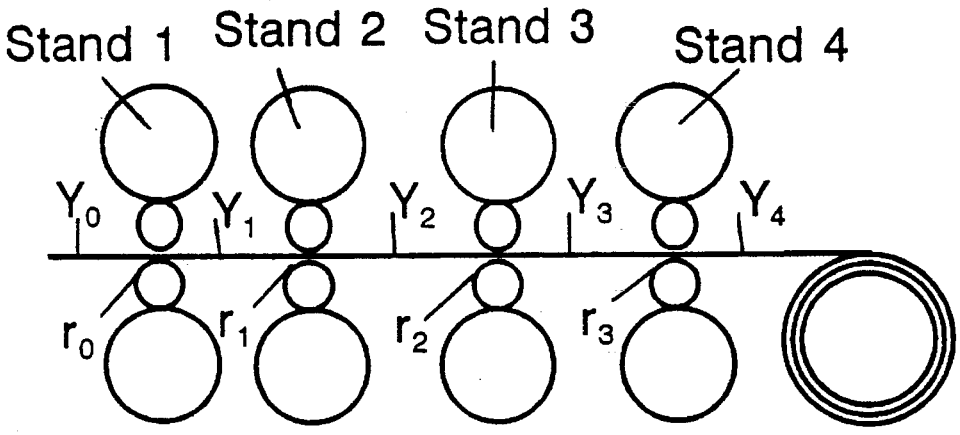
FIG. 3 illustrates the mathematical relationship between rolling mill devices and the setup parameters in accordance with an embodiment of the subject invention.

In FIG. 3, the corresponding location of the elements of the vectors for a rolling mill illustrated in FIG. 1 are shown. For example, using the matrix of FIG. 2, if the web material is classified in reduction category 2, that is, c=2, and the strip exit thickness is selected to be 250 mils, that is, $Y_4$=250 mils, then the interstand thicknesses, $Y_3$ to $Y_1$ can be calculated from the matrix X according to the first equation above to be 350 mils, 550 mils and 950 mils, respectively. The entry thickness, $Y_0$, also is calculated using this equation; thus, the required entry thickness for this example is 1500 mils. The percentage reductions are calculated according to the second equation above. Accordingly, for this example, the percentage reductions $r_1$ to $r_4$ are 37%, 42%, 36% and 29%, respectively.

Because the thickness reduction of each stand affects the temperatures in the rolling mill, the first stand in the rolling mills like the other stands must be fed a strip having a thickness (entry thickness) determined from the relationship between the classes and the thicknesses as represented in matrix X as well as the desired exit coil thickness to allow for schedule free rolling without the need for cooling sprays or other temperature adjusting devices. Accordingly different exit coil thicknesses can be obtained by varying the entry slab thickness proportionally for different desired exit coil thicknesses. Since this entry thickness can tabulated or calculated beforehand at the rolling mill, an operator can determine if a supply of the web material having the required entry thickness is available for the desired product or will have to be obtained.

Alternatively, if the operator is unable control the entry thickness also referred to as the entry slab thickness the thickness reduction for the first stand in the rolling mill can be selected to deviate from that required by the matrix X to produce the required thickness for the next stand so that bite refusals will be limited primarily to the first stand. Also the strip can be cooled by other devices between the first stand and the other stands to maintain the temperature needed for schedule free rolling. However, in the preferred embodiment, the operator or controller 170 is able to control the entry slab thickness in accordance with the requirements of matrix X.

The subject invention has been tested and found to yield very robust, consistent and predictable mill operating conditions which result in more consistent and predictable head-end shape in the presence of width, alloy and thickness changes with minimal manual use of other actuators, such as roll benders and sprays.

It is to be understood that the invention is not limited to the features and embodiments hereinabove set forth, but may be carried out in other ways without departure from its spirit.

What is claimed is:

1. A method for selecting setup parameters for a rolling mill comprising a plurality of mill stands which reduces the thickness of web materials comprising the steps of:

(a) determining a plurality of web material classes for the web materials processed by the rolling mill according to similar hardness and rollability characteristics;

(b) determining an interstand class thickness for web material of each web material class to have between each stand in the rolling mill such that temperatures remain substantially constant;

(c) selecting a product to produce in the rolling mill, said product being made from a particular web material;

(d) determining which of said web material classes includes said particular web material;

(e) determining a particular exit thickness for said product; and (f) calculating particular interstand thicknesses and a particular entry thickness for said particular web material according to said interstand class thicknesses for said determined web material class.

2. A method for determining setup parameters for a rolling mill comprising a plurality of mill stands which reduces the thickness of web material comprising the steps of:

(a) determining a plurality of web material classes according to similar hardness and rollability characteristics;

(b) determining an interstand class thickness for web material of each web material class to have between each stand in the rolling mill at which a temperature remains constant; and (c) storing said interstand class thicknesses as elements in a web material class versus stand matrix.

3. A method for determining setup parameters for a rolling mill comprising a plurality of mill stands which reduces the thickness of web material comprising the steps of:

(a) determining a plurality of web material classes according to hardness and rollability characteristics;

(b) determining a draft for each stand in the rolling mill at which a temperature remains constant for web material of each web material class; and (c) storing said drafts as elements in a web material class versus stand matrix.

4. A method for selecting setup parameters for a rolling mill comprising a plurality of mill stands which reduces the thickness of a web material comprising the steps of:

(a) selecting a product to produce in the rolling mill, said product being made from a particular web material;

(b) determining which of a plurality of web material classes includes said particular web material;

(f) determining a particular exit thickness for said product; and (g) calculating a particular draft for each stand and a particular entry thickness for said particular web material according to a predetermined class versus stand relationship.

5. A method according to claim 4, wherein said predetermined class versus stand relationship is a matrix.

6. A method for determining setup parameters for a rolling mill comprising a plurality of mill stands which reduces the thickness of web material comprising the steps of:

(a) selecting a setup class, an entry thickness and an exit thickness;

(b) calculating an interstand thickness for each stand in the rolling mill based on said exit thickness and predetermined stand drafts for said setup class; and (c) determining if said entry thickness will result in a bite refusal by any of said stands in the rolling mill.

7. A rolling mill for processing a web material comprising:

a plurality of rolling stands for successively reducing the thickness of the web material;

a plurality of detectors for measuring a thickness of the web material output from each of said rolling stands and for generating respective detected thickness signals; and a controller for generating respective command signals for each of said rolling stands according to said detected thickness signals and respective thickness setpoint signals such that said command signals drive each of said rolling stands to output web material having a respective predetermined thickness;

wherein each of said thickness setpoint signals is determined from a predetermined relationship between hardness and rollability characteristics of the web material and said predetermined thicknesses for maintaining substantially constant temperatures.

8. A rolling mill according to claim 7, wherein said predetermined relationship is a matrix having elements representing setup drafts of said rolling stands.

9. A rolling mill according to claim 7, wherein said predetermined relationship is a matrix having rows and columns, each row comprising elements that relate said predetermined thicknesses for web material having similar said hardness and rollability characteristics to each of said rolling stands.

10. A control system for a rolling mill which processes a web material comprising:

a plurality of detectors for measuring a thickness of the web material output from successive thickness reducing devices and for generating respective detected thickness signals; and a controller for generating respective command signals for each of the thickness reducing devices according to said detected thickness signals and respective thickness setpoint signals, such that said command signals drive each of the thickness reducing devices to output web material having a respective predetermined thickness;

wherein each of said thickness setpoint signals is determined from a predetermined relationship between hardness and rollability characteristics of the web material and said predetermined thicknesses for maintaining substantially constant temperatures.

* * * * *